US011083254B2

(12) United States Patent
Kojima et al.

(10) Patent No.: US 11,083,254 B2
(45) Date of Patent: Aug. 10, 2021

(54) SLIDER FOR SLIDE FASTENER

(71) Applicant: YKK Corporation, Tokyo (JP)

(72) Inventors: Masayoshi Kojima, Kurobe (JP); Takayuki Inukai, Kurobe (JP); Yoshikazu Hamada, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/761,601

(22) PCT Filed: Nov. 8, 2017

(86) PCT No.: PCT/JP2017/040215
§ 371 (c)(1),
(2) Date: May 5, 2020

(87) PCT Pub. No.: WO2019/092801
PCT Pub. Date: May 16, 2019

(65) Prior Publication Data

US 2020/0268114 A1 Aug. 27, 2020

(51) Int. Cl.
*A44B 19/28* (2006.01)

(52) U.S. Cl.
CPC ..... *A44B 19/28* (2013.01)

(58) Field of Classification Search
CPC ..... A44B 19/28
See application file for complete search history.

(56) References Cited

U.S. PATENT DOCUMENTS 2,764,794 A 10/1956 Meech et al.
2,807,853 A 10/1957 Chery
2009/0049659 A1* 2/2009 Takani ..... A44B 19/26 24/426
2013/0139362 A1 6/2013 Sato
2013/0139363 A1 6/2013 Sato
(Continued)

FOREIGN PATENT DOCUMENTS

CN 2737188 Y 11/2005
IT 20161222 A1 9/2017
(Continued)

OTHER PUBLICATIONS

International Search Report, PCT Application No. PCT/JP2017/040215, dated Dec. 12, 2017.
(Continued)

*Primary Examiner* — Robert Sandy
*Assistant Examiner* — David M Upchurch
(74) *Attorney, Agent, or Firm* — Kilpatrick Townsend & Stockton LLP

(57) ABSTRACT

A slider for slide fastener includes: a slider body including an upper blade and a lower blade which are separate from and face each other in an upward and downward direction, and a guide post which connects the upper blade and the lower blade on a front end side; and a pull tab which is attached to the slider body. A cutout region is formed in at least one of both sides in a width direction of the upper blade, the both sides in the width direction sandwiching the guide post. The cutout region is formed of a side edge portion extending toward an outer side in the width direction of the guide post and being arranged along a front and rear direction, and a front edge portion.

6 Claims, 7 Drawing Sheets

(56) References Cited

U.S. PATENT DOCUMENTS

| | | | | |
|---|---|---|---|---|
| 2013/0139364 | A1 | 6/2013 | Sato | |
| 2013/0139365 | A1 | 6/2013 | Sato | |
| 2013/0232736 | A1 | 9/2013 | Sato | |
| 2018/0000203 | A1 | 1/2018 | Jin | |
| 2019/0223561 | A1* | 7/2019 | Kojima | A44B 19/28 |

FOREIGN PATENT DOCUMENTS

| | | | |
|---|---|---|---|
| JP | S46-004267 | U | 2/1971 |
| JP | S52-000302 | U | 1/1977 |
| JP | S58-105704 | A | 6/1983 |
| JP | D1144206 | S | 6/2002 |
| JP | 2009-273852 | A | 11/2009 |
| JP | 2016-209504 | A | 12/2016 |
| WO | 2012-020491 | A1 | 2/2012 |
| WO | 2016/114456 | A1 | 7/2016 |

OTHER PUBLICATIONS

Written Opinion, PCT Application No. PCT/JP2017/040215, dated Dec. 12, 2017.

International Preliminary Report on Patentability, PCT Application No. PCT/JP2017/040215, dated May 12, 2020.

Extended European Search Report, European Patent Application No. 17931434.9, dated May 31, 2021.

* cited by examiner

SLIDER FOR SLIDE FASTENER

TECHNICAL FIELD

The present invention relates to a slider for slide fastener.

BACKGROUND ART

In a known slider for slide fastener according to related art, a slider body includes an upper blade, a lower blade, and a guide post that connects the upper blade and the lower blade at a front end portion, and a cutout portion is formed on both sides of a front end portion of the upper blade, so that an insert pin of an open part can be easily inserted into the slider (see, for example, Patent Literature 1).

In another known slider for slide fastener according to the related art, a lower blade and a guide post of a slider body are extended in front of an upper blade, so that the insert pin of the open part can be easily inserted into the slider (see, for example, Patent Literature 2).

CITATION LIST

Patent Literature

[Patent Literature 1] JP-UM-A-S52-000302
[Patent Literature 2] JP-A-2016-209504

SUMMARY OF INVENTION

Technical Problem

However, in the slider described in above Patent Literature 1, since fastener elements are guided only by the lower blade during operating the slider and not guided by the upper blade, engagement performance of the fastener elements is lowered, and it is difficult to engage the fastener elements.

In the slider described in above Patent Literature 2, since the lower blade and the guide post are extended in front of the upper blade, a size of the slider is increased and designability thereof is reduced. Moreover, when the slider is moved to a state where a slide fastener is completely closed, the extended lower blade and the guide post may contact a wearer.

The present invention has been made in view of the above-described circumstances, and an object thereof is to provide a slider for slide fastener in which an insert pin of an open part can be easily inserted into the slider while maintaining engagement performance of fastener elements.

Solution to Problem

The object of the present invention is achieved by the following configurations.

(1) A slider for slide fastener includes: a slider body including an upper blade and a lower blade, which are separate from and face each other in an upward and downward direction, and a guide post which connects the upper blade and the lower blade on a front end side; and a pull tab which is attached to the slider body. A cutout region is formed in at least one of both sides in a width direction of the upper blade, the both sides in the width direction sandwiching the guide post. The cutout region is formed of a side edge portion extending toward an outer side in the width direction of the guide post and being arranged along a front and rear direction, and a front edge portion extending from a rear end of the side edge portion toward an outer side in the width direction. The lower blade includes a placement portion located on an outer side in the width direction of the side edge portion and in front of the front edge portion.

(2) The slider for slide fastener according to (1), a pull tab attachment portion, which is configured to attach the pull tab to the slider body, is provided above the side edge portion.

(3) The slider for slide fastener according to (2), the pull tab attachment portion is provided at a center in the width direction on the upper blade.

(4) The slider for slide fastener according to, the cutout region is formed on the both sides in the width direction which sandwich the guide post.

(5) The slider for slide fastener according to, the slider body includes flanges provided along both side edges in the width direction of at least one of the upper blade and the lower blade. The guide post includes a connecting portion located on a front side, and an element guide portion which is located on a rear side and which guides a fastener element. The element guide portion is formed in such a shape whose width dimension gradually decreases as it goes rearward from a rear end of the connecting portion. A first boundary position between the side edge portion and the front edge portion is arranged in front of a second boundary position between the connecting portion and the element guide portion and arranged behind a front end of the guide post. The front edge portion is formed from the first boundary position toward front ends of the flanges.

(6) The slider for slide fastener according to, a continuous element guide region is formed by lower surfaces of the side edge portion and the front edge portion.

Effects of Invention

According to the present invention, the cutout region is formed in at least one of the both sides in a width direction of the upper blade, the both sides in the width direction sandwiching the guide post. The cutout region is formed of the side edge portion extending toward an outer side in the width direction of the guide post and being arranged along the front and rear direction, and the front edge portion extending from the rear end of the side edge portion toward the outer side in the width direction. The lower blade includes the placement portion located on the outer side in the width direction of the side edge portion and in front of the front edge portion. Therefore, the insert pin of the open part can be easily inserted into the slider while the engagement performance of the fastener elements can be maintained.

DESCRIPTION OF EMBODIMENTS

Figure 1:
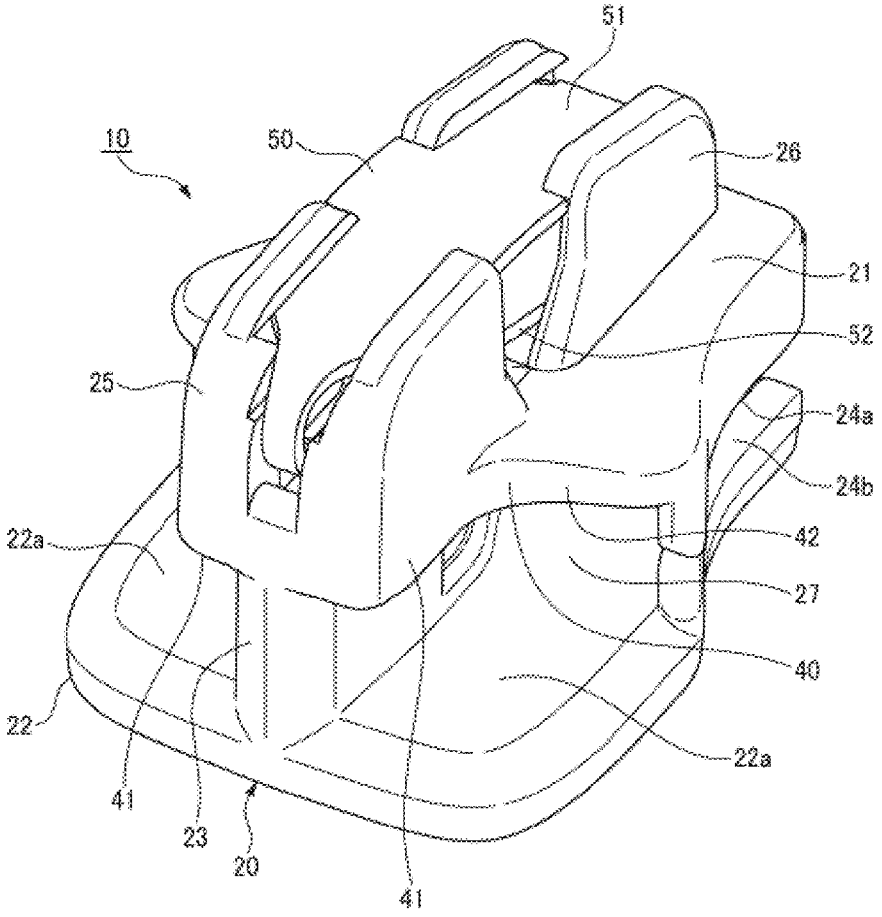
FIG. 1 is a perspective view showing an embodiment of a slider for slide fastener according to the present invention.

Hereinafter, an embodiment of a slider for slide fastener according to the present invention will be described in detail with reference to the drawings. In the following description, an upper side refers to a front side with respect to the page of FIG. 2, a lower side refers to a back side with respect to the page of FIG. 2, a front side refers to an upper side with respect to the page of FIG. 2, a rear side refers to a lower side with respect to the page of FIG. 2, a left side refers to a left side with respect to the page of FIG. 2, and a right side refers to a right side with respect to the page of FIG. 2. A right and left direction is also referred to as a width direction. A front and rear direction is also referred to as a length direction.

As shown in FIGS. 1 to 4, a slider 10 for slide fastener according to the present embodiment (hereinafter, also simply referred to as "slider 10") is a slider which has an automatic stop function, and includes a slider body 20, a pull tab 11, and a locking member 50. Although the slider 10 is a slider which has the automatic stop function in the present embodiment, the slider 10 may be a slider which does not have the automatic stop function. In FIGS. 1, 2, and 5 to 7, a description of the pull tab 11 is omitted to facilitate understanding of the drawings.

As shown in FIGS. 1 to 4, the slider body 20 includes: an upper blade 21 and a lower blade 22 which are separate from and face each other in an upward and downward direction; a guide post 23 which connects the upper blade 21 and the lower blade 22 at a front end portion; flanges 24*a* protruding downward along right and left side edges in the width direction of the upper blade 21; flanges 24*b* protruding upward along right and left side edges of the lower blade 22; a front side attachment portion 25 to which the locking member 50 is attached, the front side attachment portion 25 being erected on a front end portion of the upper blade 21; and a rear side attachment portion 26 to which the locking member 50 is attached, the rear side attachment portion 26 being erected on a rear end portion of the upper blade 21. The front side attachment portion 25 and the rear side attachment portion 26 constitute a pull tab attachment portion that attaches the pull tab 11 to the slider body 20. As a result, right and left shoulder mouths 27, which are separated from each other by the guide post 23, are formed in a front portion of the slider body 20, while a rear mouth 28 is formed in a rear portion of the slider body 20. A substantially Y-shaped element guide path 29, which communicates the right and left shoulder mouths 27 and the rear mouth 28, is formed between the upper blade 21 and the lower blade 22. The element guide path 29 forms a path through which a fastener element (not shown) is inserted. The slider body 20 is made of metal or synthetic resin.

Figure 4:
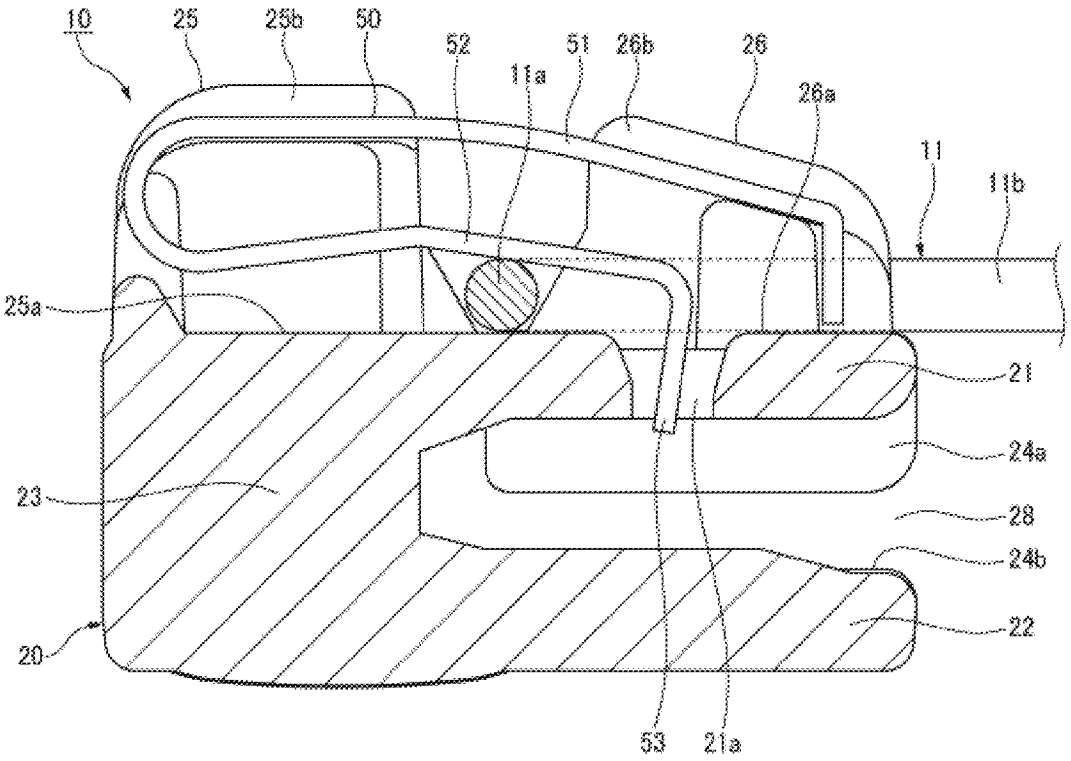
FIG. 4 is a cross-sectional view taken along line A-A of FIG. 2.

The locking member 50 is formed by cutting a wire material whose cross section has a rectangular shape, such as stainless steel, into a predetermined length and bending the wire material. As shown in FIG. 4, the locking member 50 includes: an upper piece 51 and a lower piece 52 formed by bending the wire material into a substantially U shape; and a stop claw 53 extending downward from a rear end portion of the lower piece 52.

Figure 2:
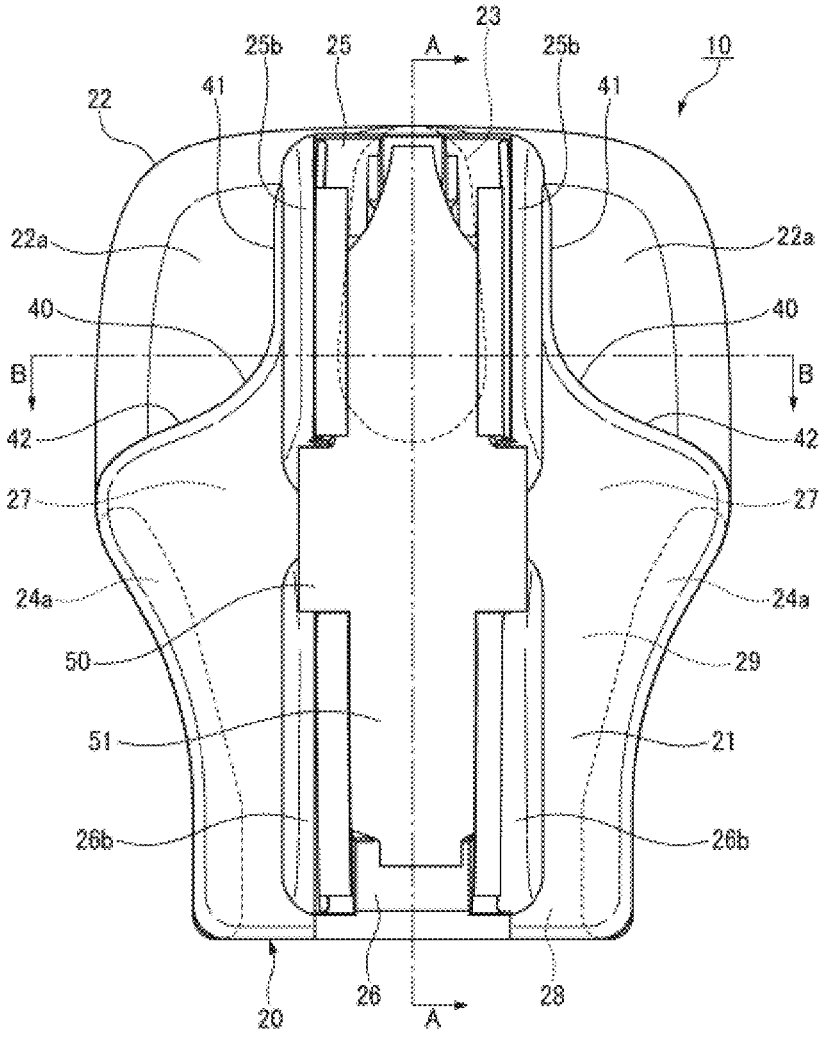
FIG. 2 is a top view of the slider shown in FIG. 1.

As shown in FIGS. 2 and 4, the front side attachment portion 25 and the rear side attachment portion 26 respectively includes accommodation grooves 25*a*, 26*a* that accommodate the locking member 50. The accommodation grooves 25*a*, 26*a* include right and left side walls 25*b*, 26*b*, respectively. The locking member 50 is accommodated in the accommodation grooves 25*a*, 26*a* of the front side attachment portion 25 and the rear side attachment portion 26, and upper end portions of the right and left side walls 25*b*, 26*b* are crimped in a direction approaching each other. In this way, the upper piece 51 of the locking member 50 is fixed to the front side attachment portion 25 and the rear side attachment portion 26. Moreover, a claw hole 21*a*, in which the stop claw 53 of the locking member 50 is inserted, is formed in the upper blade 21 so as to penetrate the upper blade 21 in the upward and downward direction.

Figure 3:
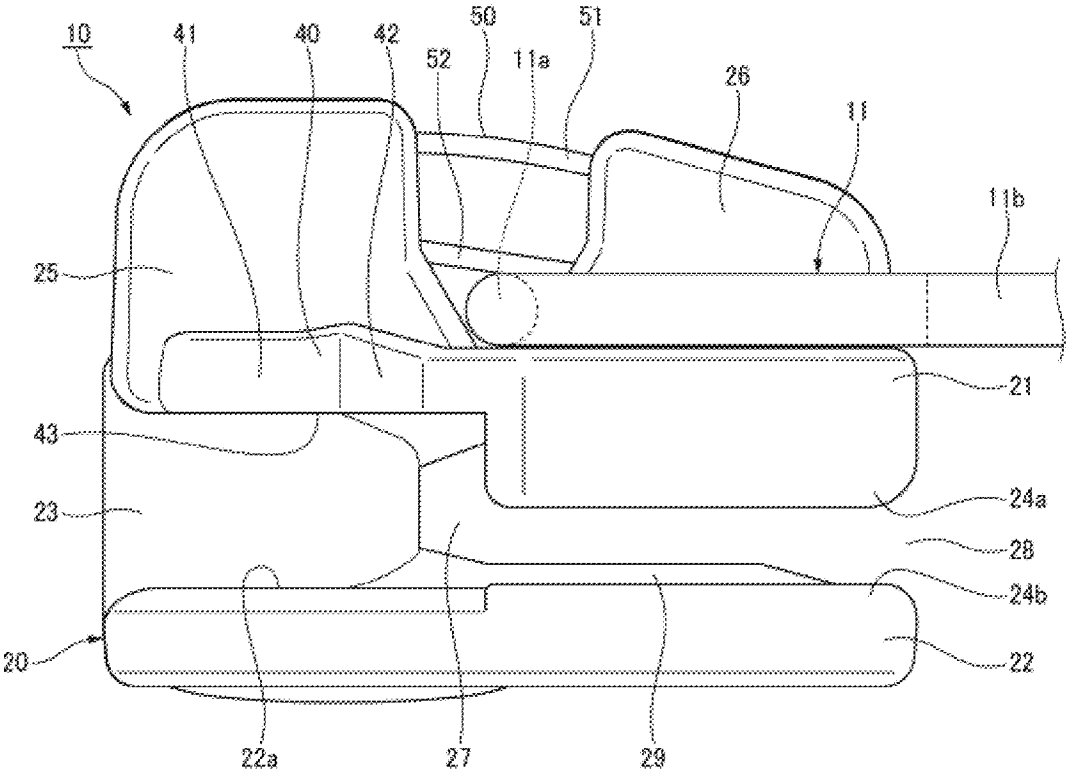
FIG. 3 is a left side view of the slider shown in FIG. 1.

As shown in FIGS. 3 and 4, the pull tab 11 includes a link shaft 11*a* arranged between the front side attachment portion 25 and the rear side attachment portion 26 of the slider body 20, and a plate-shaped grip portion 11*b* extending from the link shaft 11*a*. The front side and rear side attachment portions 25, 26 attach the pull tab 11 to the slider body 20, and the lower piece 52 of the locking member 50 is arranged on the link shaft 11*a* of the pull tab 11 by attaching the locking member 50 to the front side and rear side attachment portions 25, 26, so that the pull tab 11 is attached to the slider body 20.

Figure 5:
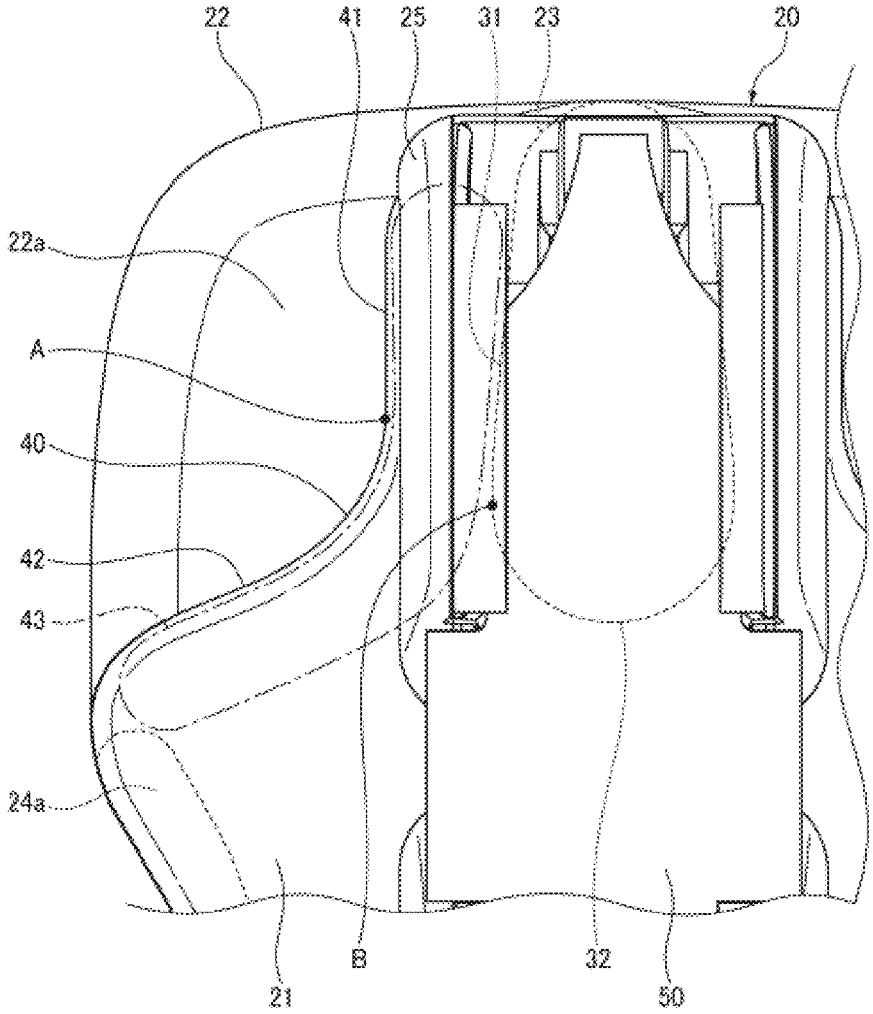
FIG. 5 is an enlarged top view of a periphery of a cutout region on a left side of FIG. 2.
Figure 6:
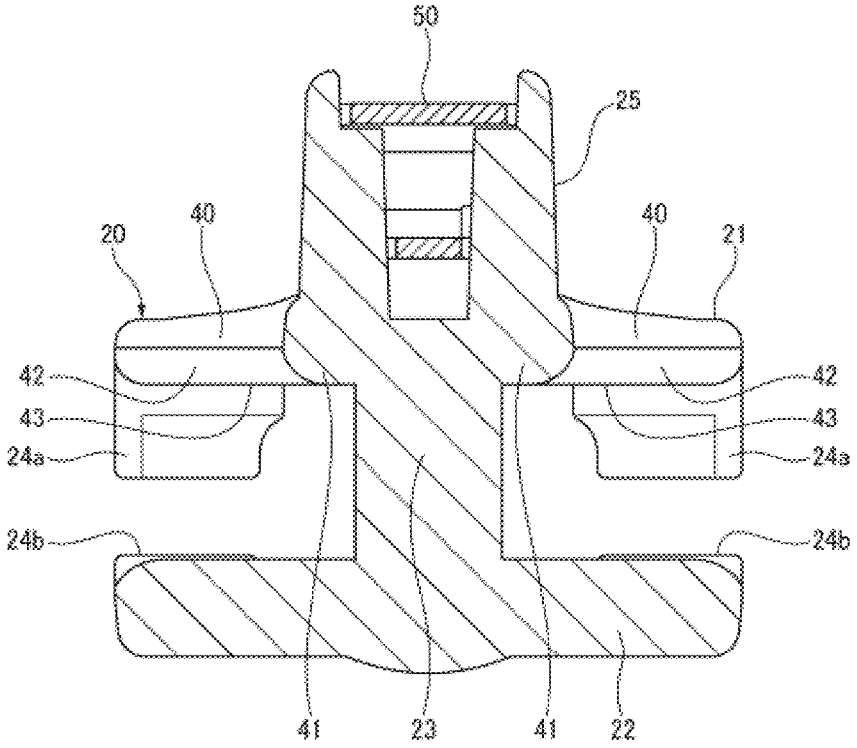
FIG. 6 is a cross-sectional view taken along line B-B of FIG. 2.

As shown in FIGS. 1 to 3, a cutout region 40 is formed on both sides in the width direction of the upper blade 21, the both sides in the width direction sandwiching the guide post 23. As shown in FIGS. 5 and 6, the cutout region 40 is formed of a side edge portion 41 extending toward an outer side in the width direction of the guide post 23 and being arranged along a front and rear direction, and a front edge portion 42 extending from a rear end of the side edge portion 41 toward the outer side in the width direction. As a result, a front end edge of the upper blade 21 on the side where the cutout region 40 is formed is located behind a front end edge of the lower blade 22. The front side attachment portion 25, which serves as the pull tab attachment portion for attaching the pull tab 11 to the slider body 20, is provided above the side edge portion 41. Width dimensions of the right and left side edge portions 41 are substantially the same as a width dimension of the front side attachment portion 25. The front side and rear side attachment portions 25, 26, which serve as the pull tab attachment portion, are provided at a center in the width direction on the upper blade 21. With these configurations, the cutout region 40 can be maximized while securing a region for attaching the pull tab 11 to the slider body 20, and thus an insert pin P of an open part can be easily inserted into the slider 10.

Figure 7:
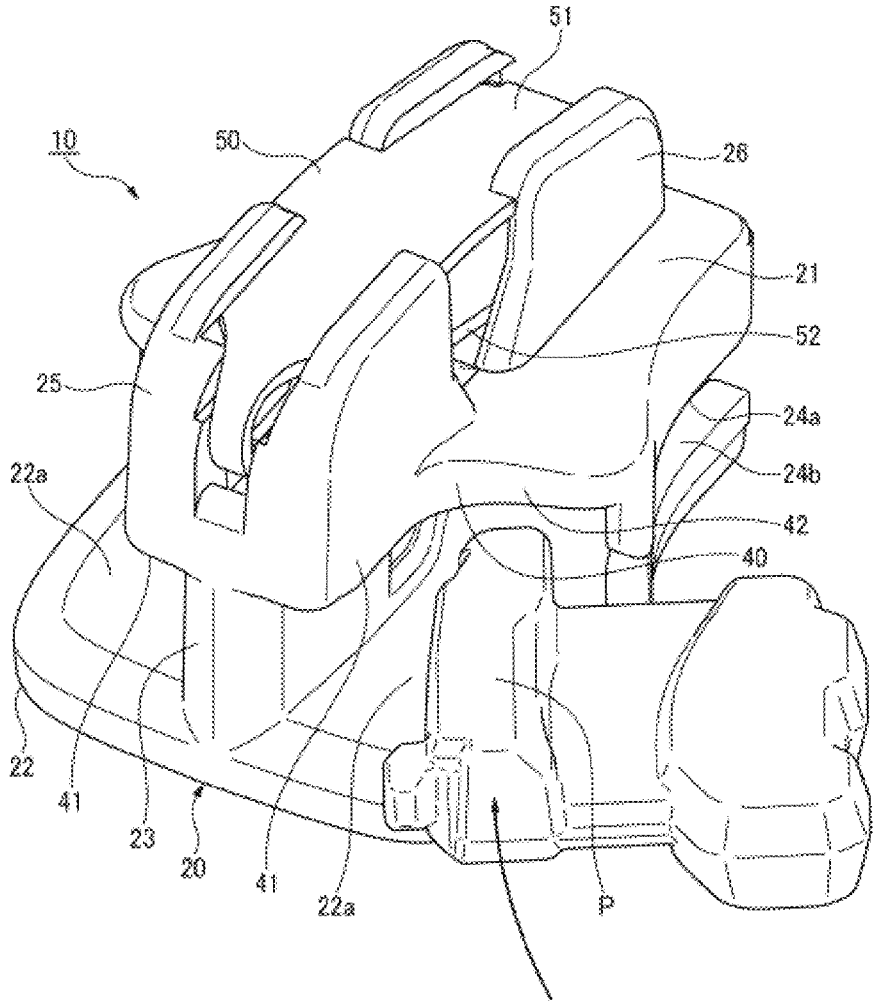
FIG. 7 is a perspective view showing a state where an insert pin is inserted into the slider.

Therefore, the lower blade 22 includes a placement portion 22*a* located on the outer side in the width direction of the side edge portion 41 and in front of the front edge portion 42. As shown in FIG. 7, the placement portion 22*a* functions as a guide when the insert pin P of the open part is inserted into the slider 10. As a result, the insert pin P of the open part can be easily inserted into the slider 10.

As shown in FIG. 5, the guide post 23 includes a connecting portion 31 located on a front side, and an element guide portion 32 which is located on a rear side and which guides a fastener element (not shown) toward the inside of the slider. A front end side surface of the connecting portion 31 is formed in an arc shape, while a rear end side surface thereof is formed in a planar shape. The element guide portion 32 is formed in an arc shape whose width dimension gradually decreases as it goes rearward from a rear end of the connecting portion 31.

In the present embodiment, a first boundary position A between the side edge portion 41 and the front edge portion 42 is arranged in front of a second boundary position B between the connecting portion 31 and the element guide portion 32 and arranged behind a front end of the guide post 23. The side edge portion 41 is a portion which extends toward the outer side in the width direction of the guide post 23 and which is linearly arranged along the front and rear direction. The front edge portion 42 is a portion which extends in a curved shape from the rear end of the side edge portion 41 toward the outer side in the width direction. The first boundary position A is also a position where a curved portion of a front end edge of the front edge portion 42 and a linear portion of a side end edge of the side edge portion 41 switch to each other. The second boundary position B is also a position where a planar portion and an arc-shaped portion of a side surface of the guide post 23 switch to each other.

The front edge portion 42 is formed obliquely from the first boundary position A toward a front end of the flange 24*a*. In other words, the front edge portion 42 is formed obliquely from the first boundary position A toward the outer side in the width direction and toward the rear side. Further, an outer edge of the front edge portion 42 is formed so as to draw a substantially S-shaped smooth curve, since a corner portion is not formed.

The element guide portion 32 is a portion that serves as a guide for guiding the fastener element into the slider and engaging right and left fastener elements. In order to engage the fastener elements in a correct posture, it is preferable to guide the fastener elements by both the upper blade 21 and the lower blade 22 behind the second boundary position B.

In the slider 10 configured as described above, a continuous curved element guide region 43, which extends from the front end of the guide post 23 toward the front end of the flange 24*a*, is formed by lower surfaces of the side edge portion 41 and the front edge portion 42 (see FIG. 5). Therefore, since the fastener elements are guided by both the upper blade 21 and the lower blade 22 during operating the slider, engagement performance of the fastener elements can be maintained at the same level as that of a normal slider. The normal slider in this case refers to a slider in which no cutout region is formed in the upper blade.

As described above, according to the slider 10 for slide fastener according to the present embodiment, the cutout region 40 is formed in the both sides in the width direction of the upper blade 21, the both sides in the width direction sandwiching the guide post 23. The cutout region 40 is formed of the side edge portion 41 extending toward the outer side in the width direction of the guide post 23 and being arranged along the front and rear direction, and the front edge portion 42 extending from the rear end of the side edge portion 41 toward the outer side in the width direction. The lower blade 22 includes the placement portion 22*a* located on the outer side in the width direction of the side edge portion 41 and in front of the front edge portion 42. Therefore, the insert pin P of the open part can be easily inserted into the slider 10 while the engagement performance of the fastener elements can be maintained.

According to the slider 10 for slide fastener according to the present embodiment, the element guide portion 32 is formed in the arc shape whose width dimension gradually decreases as it goes rearward from the rear end of the connecting portion 31. The first boundary position A between the side edge portion 41 and the front edge portion 42 is arranged in front of the second boundary position B between the connecting portion 31 and the element guide portion 32 and arranged behind the front end of the guide post 23. The front edge portion 42 is formed obliquely from the first boundary position A toward the front end of the flange 24*a*. Therefore, the posture of the fastener elements can be stabilized during operating the slider, and the engagement performance of the fastener elements can be further maintained.

The present invention is not limited to the embodiment described above, and can be appropriately modified without departing from the gist of the present invention.

For example, the cutout region in the above embodiment is formed on the both sides in the width direction, which sandwich the guide post, of the upper blade. However, the present invention is not limited thereto, and the cutout region may be formed only on a left side where the insert pin of the open part is inserted. This is a case where the slider is a slider in which the insert pin is inserted into the shoulder mouth on the left side. Accordingly, in a case where the slider is a slider in which the insert pin is inserted into the shoulder mouth on the right side, the cutout region may be formed only on the right side.

Although a case where the present invention is applied to the slider which includes the locking member and has the automatic stop function is exemplified in the above embodiment, the present invention is not limited thereto, and the present invention may be applied to a non lock slider which does not includes any locking member. In this case, the pull tab is attached to a pull tab attachment post (pull tab attachment portion) provided above the side edge portion.

DESCRIPTION OF REFERENCE SIGNS

10 Slider for slide fastener
11 Pull tab
20 Slider body
21 Upper blade
22 Lower blade
22*a* Placement portion
23 Guide post
24*a* Flange
24*b* Flange
25 Front side attachment portion (pull tab attachment portion)
26 Rear side attachment portion (pull tab attachment portion)
27 Shoulder mouth
28 Rear mouth
29 Element guide path
31 Connecting portion
32 Element guide portion
40 Cutout region
41 Side edge portion
42 Front edge portion
43 Element guide region
50 Locking member
A First boundary position
B Second boundary position
P Insert pin

The invention claimed is:

1. A slider for slide fastener comprising:

a slider body including an upper blade and a lower blade which are separate from and face each other in an upward and downward direction, and a guide post which connects the upper blade and the lower blade on a front end side; and a pull tab which is attached to the slider body, wherein a cutout region is formed in at least one of both sides in a width direction of the upper blade, the both sides in the width direction sandwiching the guide post, wherein the cutout region is formed of a side edge portion extending toward an outer side in the width direction of the guide post and being arranged along a front and rear direction, and a front edge portion extending from a rear end of the side edge portion toward an outer side in the width direction, and wherein the lower blade includes a placement portion located on an outer side in the width direction of the side edge portion and in front of the front edge portion.

2. The slider for slide fastener according to claim 1, wherein a pull tab attachment portion, which is configured to attach the pull tab to the slider body, is provided above the side edge portion.

3. The slider for slide fastener according to claim 2, wherein the pull tab attachment portion is provided at a center in the width direction on the upper blade.

4. The slider for slide fastener according to claim 1, wherein the cutout region is formed on the both sides in the width direction which sandwich the guide post.

5. The slider for slide fastener according to claim 1, wherein the slider body includes flanges provided along both side edges in the width direction of at least one of the upper blade and the lower blade, wherein the guide post includes a connecting portion located on a front side, and an element guide portion which is located on a rear side and which guides a fastener element, wherein the element guide portion is formed in such a shape whose width dimension gradually decreases as it goes rearward from a rear end of the connecting portion, wherein a first boundary position between the side edge portion and the front edge portion is arranged in front of a second boundary position between the connecting portion and the element guide portion and arranged behind a front end of the guide post, and wherein the front edge portion is formed from the first boundary position toward front ends of the flanges.

6. The slider for slide fastener according to claim 1, wherein a continuous element guide region is formed by lower surfaces of the side edge portion and the front edge portion.

* * * * *